United States Patent [19]

Björnberg

[11] Patent Number: 4,685,762

[45] Date of Patent: Aug. 11, 1987

[54] INFRA-RED RADIATION DEVICE

[75] Inventor: Thomas Björnberg, Vargön, Sweden

[73] Assignee: Infrarodteknik AB, Vänersborg, Sweden

[21] Appl. No.: 693,213

[22] Filed: Jan. 18, 1985

[30] Foreign Application Priority Data

Jan. 20, 1984 [DE] Fed. Rep. of Germany ... 8401528[U]

[51] Int. Cl.[4] ..... G02B 7/00

[52] U.S. Cl. ..... 350/1.1; 250/504 R

[58] Field of Search ..... 350/1.1, 103, 107; 250/504 R

[56] References Cited

U.S. PATENT DOCUMENTS 4,606,600 8/1986 Schmidt ..... 350/1.1

*Primary Examiner*—Bruce Y. Arnold

*Attorney, Agent, or Firm*—Browdy and Neimark

[57] ABSTRACT

The present invention relates to an infra-red radiation device comprising a shell or reflector body and holders mounted on the ends thereof, and also holders for accommodating IR-lamps. Each shell or body includes a plurality of individual reflector parts comprising reflector plates preferably of parabola shape. The body holder comprises a web and a recumbent U-shaped element, located at the end of the body adjacent the open reflector side. The free leg of the U-shaped element includes a glass holder in which a glass plate can be inserted, to insulate IR-lamps from dust and dirt. The U-shaped element is provided with holes for screws. The holder or reflector and/or the body holder includes, or include, air gaps or holes intended for cooling air, which preferably cools the ends of the lamps.

3 Claims, 10 Drawing Figures

INFRA-RED RADIATION DEVICE

FIELD OF THE INVENTION

The present invention relates to an infra-red radiation device of the kind described more specifically in the preamble of claim 1.

Such radiation devices are used in widely differing fields for widely differing purposes.

SUMMARY OF THE INVENTION

The present invention relates to a infra-red radiation device comprising a reflector body having mounted thereon holders for accommodating infra-red lamps. The reflector body is provided with means for conducting cooling air and for insulating the device against the surrounding air.

The radiation device according to the present invention is intended particularly, although not exlusively, for drying and/or treating paper and other web-forming materials from which, for example, water is to be removed by evaporation. In this respect, high drying powers per unit of surface area are required if the treatment device is not to become excessively bulky and expensive. In addition, there is required a high energy efficiency, a high degree of reliability, and the possibility of servicing and maintaining the device in a ready and simple fashion. These requirements are caused by the desire to effect production, for example, on a paper machine practically continuously, without interruption, throughout the whole year. The most serious factors liable to cause disturbances in this respect are the particularly large amounts of dirt and dust generated and high air humidities.

Consequently, the object of the present invention, particularly with a view to the aforesaid difficulties, is to provide an infra-red radiation device which will counter-act these problems to the greatest possible extent.

This object is achieved in accordance with the invention by designing an infra-red radiation device of the kind mentioned in the introduction in a manner to obtain the characterizing features set forth in the characterizing clause of claim 1.

Further characterizing features of the invention and advantages afforded thereby will be apparent from the following description of a number of embodiments of the invention illustrated schematically in the accompanying drawings, these embodiments being given by way of example only. In the drawings.

In the drawings identical or like elements are identified by the same reference numerals.

Figure 1:
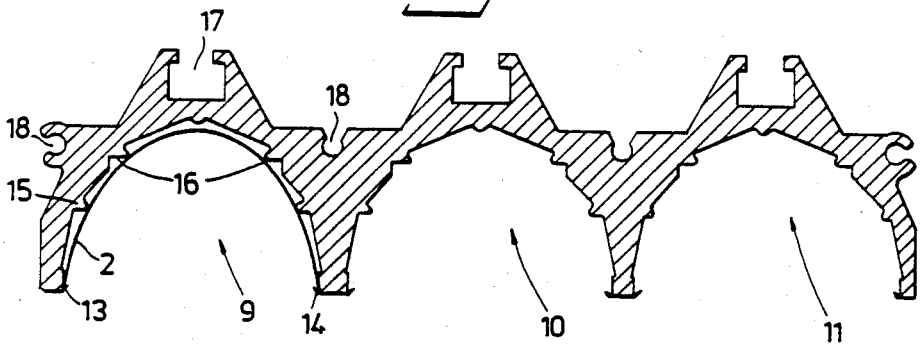
FIG. 1 is an end view of the body or shell of a first infra-red radiation device.
Figure 2:
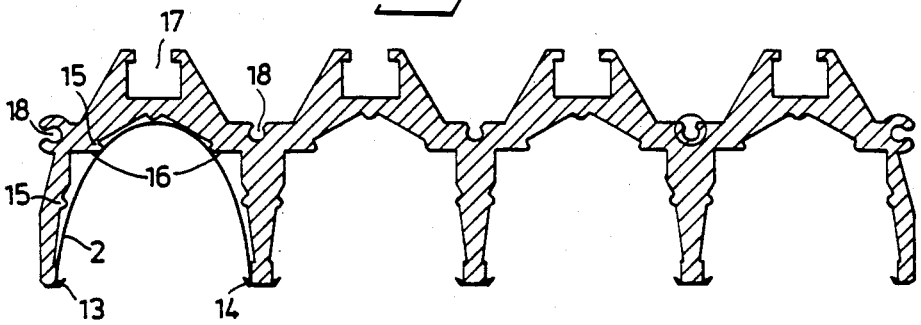
FIG. 2 is an end view of the body or shell of a second infra-red radiation device according to the invention.

In the drawings, the reference 1 identifies a shell or reflector body comprising, for example, two to five individual reflectors 9, 10, 11. The reflector body is intended to support a reflector plate or the like 2 for directing radiation 12 incident thereupon and other elements.

Consequently, an intrinsically rigid multiple arrangement of reflectors guarantees that respective infra-red lamps 5 of the arrangement do not irradiate mutually adjacent lamps, which would otherwise shorten the useful life thereof.

The reflector plates or the like 2 are mounted between projections 13, 14 which extend towards one another from the free edges of each of the reflectors. In this way, the flexible plate is curved to a parabola configuration, although without abutting the inside of the associated reflector. This is effected with the aid of spacers 15, arranged at various locations, upon which the plates 2 can rest, although it is not necessary for the plates to lie against all of the spacers of a reflector. Apart from this, the inside of each of the reflectors is of an irregular form, i.e. it follows solely the conditional shape of the inserted plate, wherewith there is formed in conjunction with the spacers continuous air gaps, which afford valuable heat insulation. This reduces the otherwise high thermal load on the reflector body. In certain instances, the spaces between plate and reflector body may be filled with a heat insulating material. It will be understood that the profile shape of the reflector body conforms substantially to the whole contour of the inserted plates.

The inside of respective reflector bodies is also characterized by planar surfaces 16 located on mutually identical levels and lying opposite one another at the transition region or juncture between the web and legs of the reflector bodies. As a result of these planar surfaces 16, holder means (not shown) can be mounted thereon when manufacturing the reflector bodies, which enables the web portions to be punched-out or recessed at the ends thereof, with the aid of a mechanical punch. This recessing is necessary in order to mount the holder means. The shell or reflector body according to the invention is most suitably extruded from aluminium or an aluminium alloy, which means that the required recesses at the ends of the reflector bodies of desired length cannot be pre-formed. Consequently, it has been necessary hitherto to mill out the desired recesses, resulting in higher working costs and longer working times. Arranged on the side of the web remote from the inside of the reflector body is a continuous, substantially C-shaped groove 17 which is open away from the reflector body and in which a lamp holder 6 or some other element can be secured, preferably with the aid of a screw or nut or like fastener.

Figure 3:
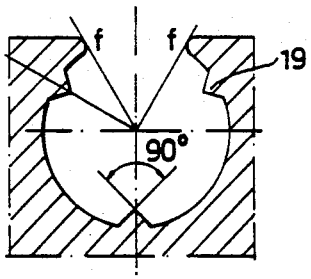
FIG. 3 is an enlarged view of a part of the device shell or body, said part being ringed in FIG. 2.
Figure 4:
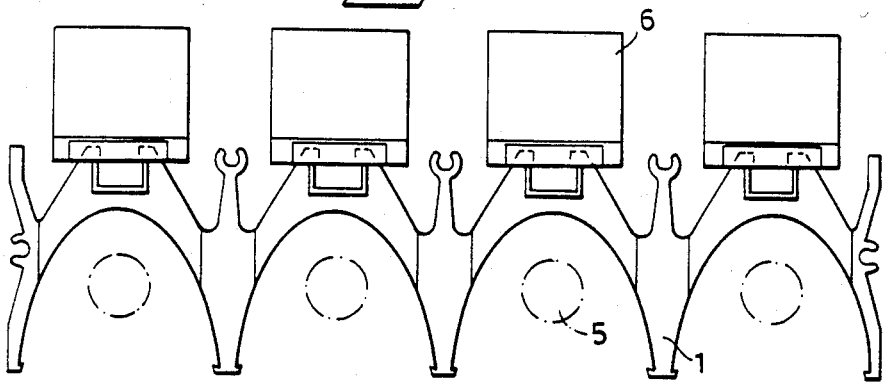
FIG. 4 is an end view of a third infra-red radiation device according to the invention, having lamp holders mounted thereon, and illustrates sources of infra-red radiation.
Figure 5:
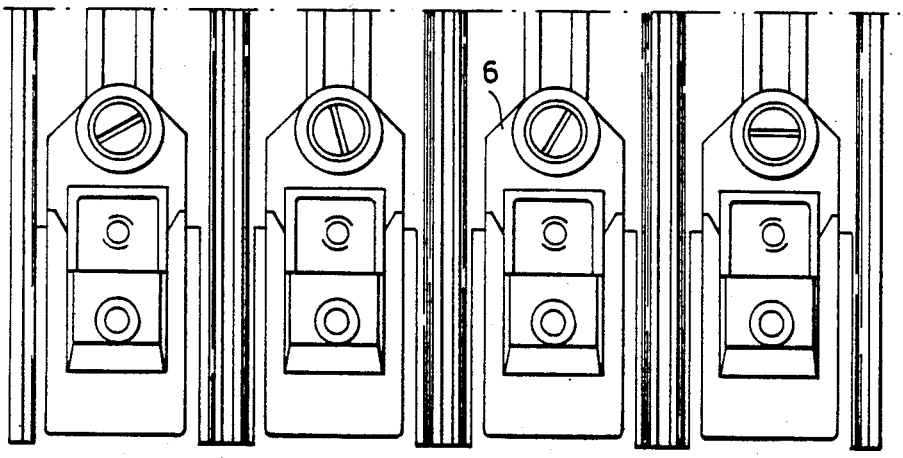
FIG. 5 is a plan view of the device illustrated in FIG. 4.
Figure 6:
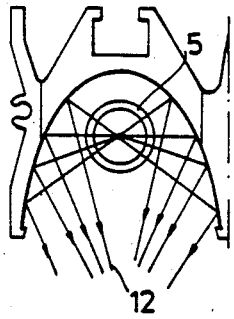
FIG. 6 illustrates the pattern of radiation obtained with an individual infra-red radiator of the device shown in FIG. 4.
Figure 7:
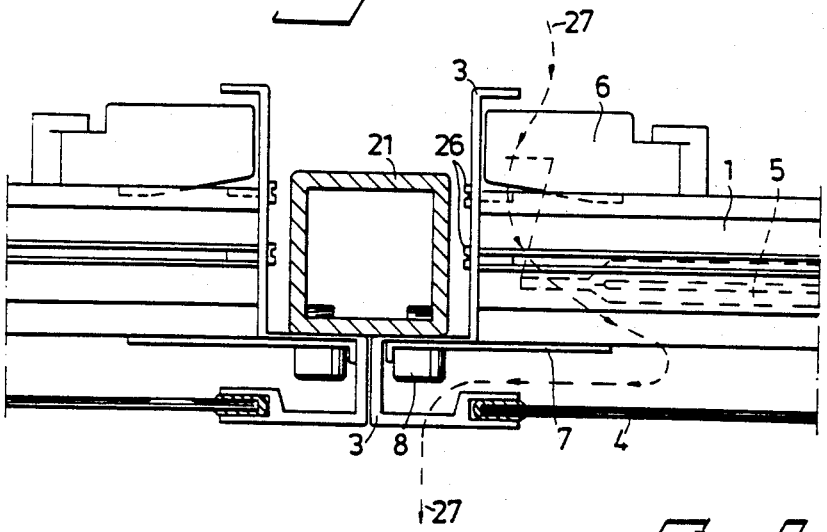
FIG. 7 is a longitudinal sectional view of mutually adjacent infra-red radiation devices provided with holder means.
Figure 8:
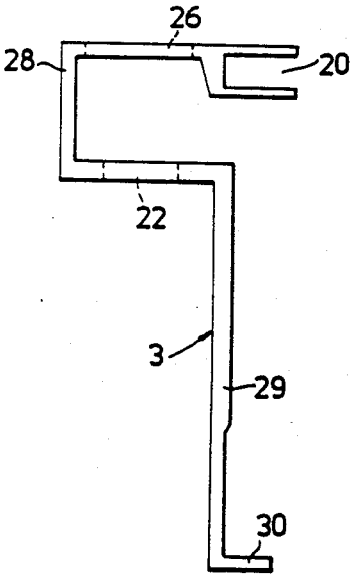
FIG. 8 is a side view of a body holder for an infra-red radiation device.
Figure 9:
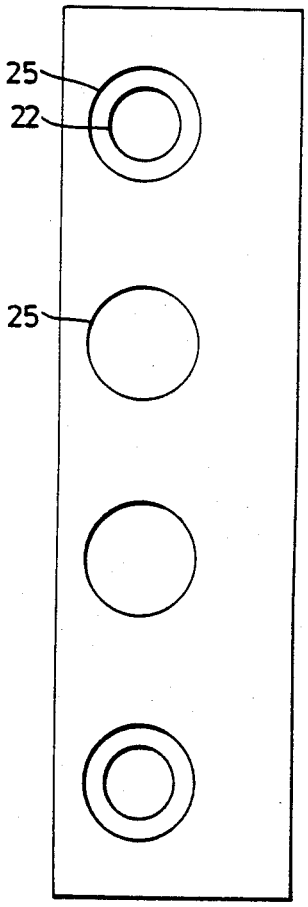
FIG. 9 is a top plan view of the body holder shown in FIG. 8.

As illustrated in larger scale in FIG. 3, in a preferred embodiment of the invention there is arranged in the web or bottom transition region between the individual reflector bodies, preferably at each location, a longitudinally extending body mounting groove 18. As will be seen from the figure, the groove 18 is enclosed by a substantially ring-shaped wall describing an angle greater than 180° in the peripheral direction, there being arranged at equal angular distances shoulders or like promontories 19 in which the thread of for example, self-tapping screws are readily able to form screw threads, so as to ensure a positive anchorage. These self-tapping screws or the like 26 serve to mount a body holder 3 in the manner illustrated in more detail in FIGS. 7–9.

As will be seen from these figures, such a body holder extends over the whole width of a multiple reflector body and is provided in the transverse direction thereof with a lower continuous U-shaped element 28, the one leg of which extends into a U-shaped glass holder 20, while the other leg of said element merges with an upwardly extending web 29 terminated at its other end with a short, angular gripping flange 30. As will be seen from FIG. 7, the glass holder 20 serves to support the end of a glass plate 4, wherewith the open side of the reflector body is shielded against the ingress of dirt, and also protected against the risk of fire, such risk being created by the ingress of combustible substances. The glass holders 20 enable glass plates to be inserted at right angles to the longitudinal direction of the reflector bodies.

The holder 3 is mounted on transverse rails or bars 21 with the aid of the outwardly projecting U-shaped element 28, more specifically with the aid of a row of holes 22, 25 formed in the two legs of said element, through which screws 8 can be inserted from the side facing the glass plate 4. These screws carry firstly a shield for the ends 7 of respective lamps and hold the shield firmly on the inside of the leg of the U-shaped element 28 merging with the web 29, at the same time as the screw-threaded portion of the screw enters a corresponding screw-threaded hole in the bar 21. The fact that the U-shaped element 28 projects outwardly in relation to the web 29 enables a plurality of reflector bodies to be mounted in mutually abutting relationship, end to end, on a common bar 21. Of the mounting holes the holes 25 adjacent the glass holder 20 are preferably provided with a larger diameter, enabling the heads of the screws 8 to pass therethrough.

Figure 10:
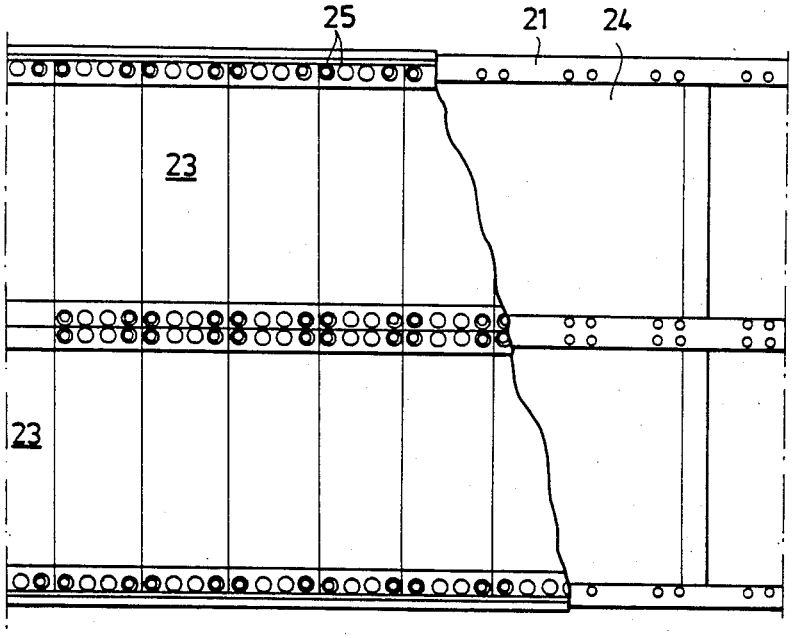
FIG. 10 is a bottom plan view of an array of infra-red radiation modules according to the invention.

As will be seen from FIG. 10, the reflector bodies are arranged in the form of modules 23, for example beneath a hood 24. Air of suitable temperature is blown into the hood 24, in order to cool the reflector bodies and the ends of the lamps. In the majority of cases, the temperature of the ends of said lamps should not exceed 300° C. As a result of the construction according to the invention, air is conducted particularly along a movement path 27, i.e. intensively past the ends of the lamps, the end shields 7 of respective lamps contributing to define said path. Finally, the air flows through holes 25 in a direction conditioned thereby. The air is heated herewith to a temperature of about 50° C. and improves thereby the drying process as a result of its directional effect. Air is also conducted herewith through the protective glass 4.

In a typical case, the temperature of the protective glass 4 will lie between 300° and 400° C., as a result of the infra-red radiation absorbed. This temperature has an intrinsic cleansing effect, since the most common binders used in the coating of paper are organic substances, for example cellulose filaments, latex and starch. These substances carbonize at temperatures above about 225° C.

The infra-red lamps 5 mounted in the lamp holders 6 can be readily replaced, by removing the screws 8, having a diameter of about 10 mm, whereupon the glass 4 can be displaced to one side and the lamp-end shield 7 lifted. This will release the lamp from the lamp holder.

In addition to conducting cooling air past the ends of the lamps, the lamp-end shields also serve to prevent reflected radiation from irradiating the ends of the lamps and therewith heating the same. Such heating of the lamp-ends would shorten the useful life of the lamp.

The reflector plates or the like 2 comprise a highly reflective material capable of withstanding high thermal loads over long periods of time. Suitable materials in this respect are gold or ceramic material. The plates can be readily withdrawn from the reflector body, for example when replacing the same. As will be understood, an inward pressing from the free side of the reflector body is also possible.

The aforedescribed embodiments illustrated in the figures of the drawings are only to be considered as nonrestricting embodiments, which can be modified and developed within the scope of the concept of the invention.

I claim:

1. An infra-red radiation device comprising:

a reflector body means having mounted thereon at least one lamp holder for accommodating IR lamps;

said reflector body means having free edges thereon and projections extending towards one another from said free edges;

a reflector plate mounted between said projections;

wherein there is provided an air gap between said reflector plate and said reflector body means.

2. The device of claim 1 wherein said reflector body comprises a plurality of separated reflectors, each reflector having a top portion and a bottom portion;

the bottom portion of each reflector lying substantially in line with the bottom potion of each other reflector;

a transition region separating each of the reflectors from each other reflector; and a common leg in the transition region between two adjacent reflectors.

3. The device of claim 2 wherein said reflector plate is flexible and is curved to a parabolic or partial elliptical shape;

spacers arranged at various locations on the inside of said reflector to provide a continuous air gap in the longitudinal direction of said reflector.

* * * * *